United States Patent [19]

Anderson

[11] Patent Number: 5,070,650

[45] Date of Patent: Dec. 10, 1991

[54] DOOR JAMB REINFORCING APPARATUS

[76] Inventor: Edward R. Anderson, 476 Sheffield Crt., Fayetteville, N.C. 28314

[21] Appl. No.: 600,914

[22] Filed: Oct. 22, 1990

[51] Int. Cl.[5] ..... E05F 11/00

[52] U.S. Cl. ..... 49/460; 49/504; 292/340

[58] Field of Search ..... 49/460, 462, 504; 52/514, 574; 292/340, 346

[56] References Cited

U.S. PATENT DOCUMENTS

| | | | |
|---|---|---|---|
| 306,806 | 10/1884 | Barnes . | |
| 1,238,924 | 9/1917 | Kennedy . | |
| 2,127,891 | 8/1938 | Starling | 292/346 |
| 3,963,269 | 6/1976 | Rosenberg . | |
| 4,074,484 | 2/1978 | Queren . | |
| 4,195,870 | 4/1980 | Fercoco | 292/340 |
| 4,223,494 | 9/1980 | Wendt | 49/504 X |
| 4,281,480 | 8/1981 | Wendt | 49/504 |
| 4,416,087 | 11/1982 | Ghatak . | |
| 4,438,597 | 3/1984 | Maggart | 49/504 X |
| 4,489,517 | 12/1984 | Young | 49/504 X |
| 4,631,866 | 12/1986 | Otto et al. . | |
| 4,635,399 | 1/1987 | Gehrke et al. . | |
| 4,673,204 | 6/1987 | Allenbaugh . | |
| 4,690,445 | 9/1987 | Hartley . | |
| 4,717,185 | 1/1988 | Hartley . | |
| 4,720,129 | 1/1988 | Bouchard | 292/346 |
| 4,858,384 | 8/1989 | Blankenship . | |

*Primary Examiner*—Rodney M. Lindsey
*Assistant Examiner*—Jerry Redman
*Attorney, Agent, or Firm*—Rosenthal & Putterman

[57] ABSTRACT

An apparatus for reinforcing a door jamb of the type having an inner bolt receiving face and a perpendicular outer face normally covered by a decorative molding. The apparatus comprises a first flat elongate metal plate adapted to be mounted flush with a portion of the inner bolt receiving face of a door jamb and including a hole defining a bolt receiving opening and a plurality of spaced apart openings adapted to receive mounting screws. A second elongate metal plate having an L-shaped cross-section and including a first side adapted to overlie the first metal plate and a second side including a second bolt receiving opening and a second plurality of spaced apart holes defining second mounting screw openings adapted to receive mounting screws. The second elongate metal plate is slidably inserted beneath a portion of the decorative molding and to lie in contacting abutting relation with a portion of the outer face of the door jamb. The openings in the first and second metal plates correspond so that they can be attached to a door frame in overlying contacting abutting relation with each other and with the door jamb with mounting screws to strengthen the door jamb.

6 Claims, 2 Drawing Sheets

DOOR JAMB REINFORCING APPARATUS

FIELD OF THE INVENTION

This invention relates generally to the field of doorway reinforcement members and particularly reinforcement members which are attachable to retrofit an existing door jamb without requiring the doorway to be dismantled.

BACKGROUND OF THE INVENTION

Most doors used in construction today are of the "pre-hung" type. More particularly, the door and door frame are prefabricated and are sold as a unit which is then installed by the purchaser. A large percentage of these pre-hung doors are made entirely of wood and are installed as entry doors. While they are intended to function to exclude uninvited guests when locked, they are often inadequate for that purpose. Unfortunately, even when properly installed, it is relatively easy for an intruder, such as a burglar to gain entry to the dwelling or business merely by forcefully kicking the door or by prying it open with a crowbar in the general vicinity where the door lock and/or the dead bolt connect the door to the door jamb, causing the door jamb to separate and allowing the door to be opened.

In response to the above-described problem, numerous devices have been developed to reinforce a door jamb to aid in preventing forced entry or to repair a door jamb once forced entry has occurred.

For example, U.S. Pat. No. 4,416,087 to Ghatak discloses a door jamb reinforcer where a brace plate is positioned internally along the depth of the door jamb adjacent the area of the bolt receiver or striker plate. The brace plate is held in place by reinforcing rods which are inserted into the door jamb internally along the face parallel to the striker plate. The reinforcing rods are preferably two-thirds the depth of the door frame and are secured by nuts. This device, while somewhat effective to prevent entry when a crow bar is used, is inadequate to prevent entry when additional force is applied, such as when a door is kicked in, as no structural connection is made between the door jamb and the structural portion of the wall.

Another attempt at reinforcing a door jamb is suggested in U.S. Pat. No. 4,635,399 to Gehrke et al. which discloses an elongate L-shaped reinforcing plate having a recessed portion with an opening therethrough that is positioned to be in alignment with a door latch on a door. The plate includes a number of openings for receiving attachment screws. One side of the L-shaped plate is in alignment with the portion of the door jamb that includes the strike plate and the other side is connected to the door frame beneath the decorative molding or door casing. However, this type of jamb support is not without its drawbacks and deficiencies. More specifically, when a door jamb is retrofitted with this plate, it is necessary to completely remove the decorative molding in order to attach the plate. Then the molding must be re-attached with care being taken to avoid hitting the plate with the nail. Furthermore, when the molding is removed, it is often necessary to repaint not only that section, but the entire door frame.

Another door jamb reinforcement plate is disclosed in U.S. Pat. No. 4,858,384 to Blankenship. The plate has an L-shaped cross section having first and second sides which are adapted to overlay the respective inside and front of a door jamb. The plate includes a number of punch-out tabs located along the length of the first side that may be selectively punched-out to facilitate alignment with the striker or bolt of each door lock. This reinforcement plate is made of sixteen-gauge, stainless steel and as a result, also requires removal of the molding in order to install the device.

With the foregoing in mind, it is an object of the present invention to provide a reinforcing plate for door jambs.

Another object of the present invention is to provide a door jamb reinforcing plate which is universally adaptable to any door jamb.

Yet another object of the present invention is to provide a door jamb reinforcing plate which can be installed without having to remove the decorative molding from around the door frame.

Still another object of the present invention is to provide a door jamb reinforcing plate which can be adapted to any door jamb using light duty tools.

SUMMARY OF THE INVENTION

The benefits and advantages of the present invention are achieved in a system for reinforcing door jambs. The typical door jamb includes an inner bolt receiving face and a perpendicular outer face normally covered by a decorative molding. The door jamb reinforcement comprises a first flat elongate metal plate that is adapted to be mounted flush with the inner bolt receiving face of the door jamb. The first metal plate includes a hole defining a bolt receiving opening and a plurality of spaced apart holes defining openings for mounting screws.

A second elongate metal plate having an L-shaped cross section having a first side and a second side, and including a second bolt receiving opening and a second plurality of spaced apart holes defining openings for mounting screws, said second elongate metal plate having a second side being adapted to be slidably inserted beneath the decorative molding and to lie in contacting abutting relation with the outer face of the door jamb. Thus, the first plate and the second plate can be connected to a door jamb in overlying contacting relation with each other and with the door jamb to strengthen the door jamb.

BRIEF DESCRIPTION OF THE DRAWINGS

Some of the features and advantages of the invention having been briefly stated, others will appear from the detailed specification which follows, when taken in connection with the accompanying drawings in which—

DETAILED DESCRIPTION OF THE ILLUSTRATED EMBODIMENT

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
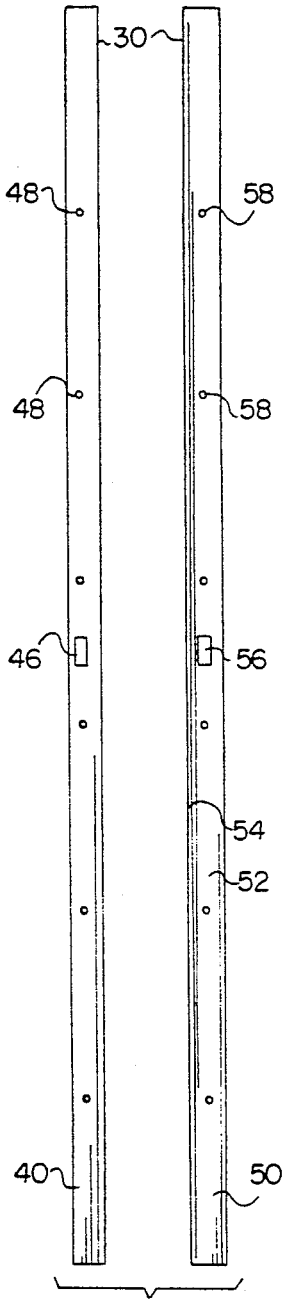
FIG. 1 is a front view of the door jamb reinforcement plates according to the present invention.
Figure 2:
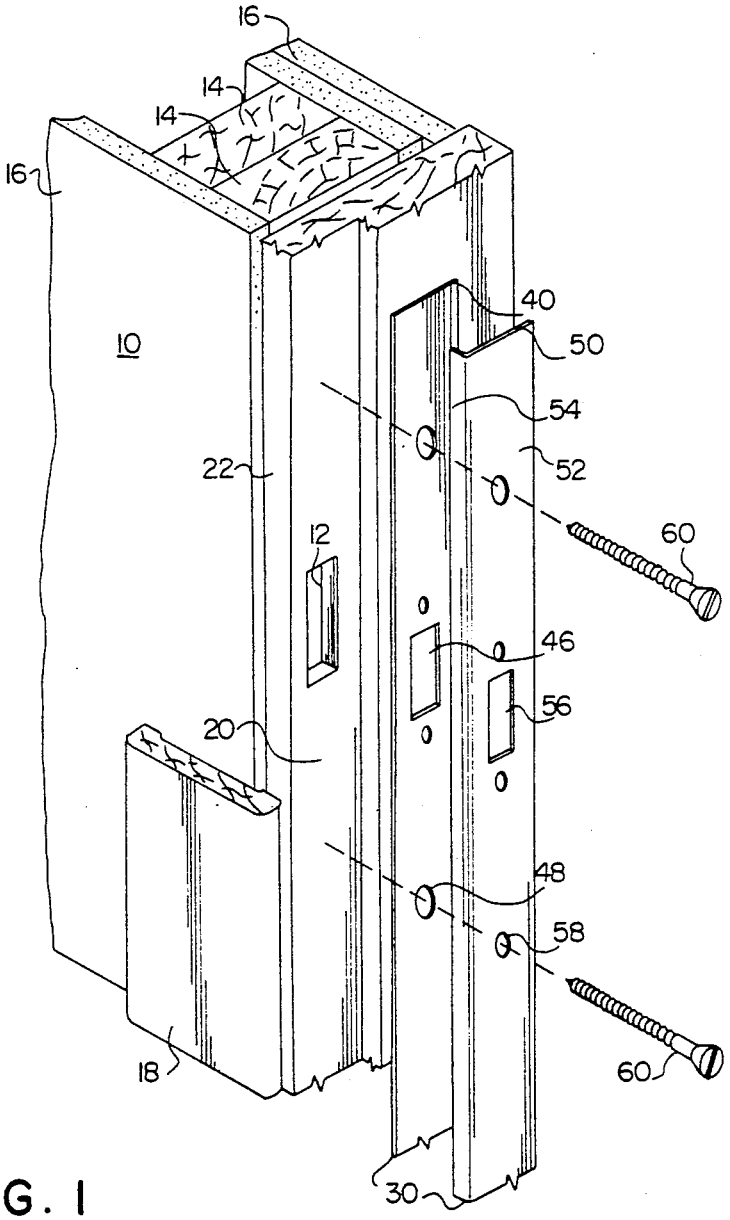
FIG. 2 is a fragmentary perspective view illustrating the door jamb reinforcement plates being attached to a door jamb according to the present invention.
Figure 3:
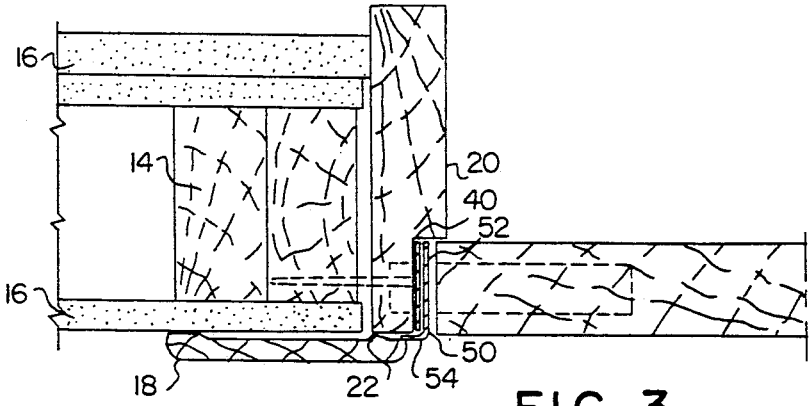
FIG. 3 is a plan view of a door jamb illustrating the completed installation thereto of the reinforcement plates according to the present invention.

Referring now more particularly to the drawings and specifically to FIG. 2, a typical door jamb is therein depicted. The door jamb reinforcing apparatus, generally indicated at 30 is installed in a door frame 10 which includes an opening 12 for receiving the dead bolt or latch of a lock (not shown). The door frame 10 is usually nailed to a wall of a building. The wall includes framing studs 14 and gypsum board or other wall material 16 which is normally nailed thereto and a decorative overlay in the form of molding or trim 18. As pertains to the installation of the door jamb reinforcing apparatus of the present invention, the door jamb may be viewed as including an inner bolt receiving face 20 and a perpendicular outer face 22 that is normally covered by molding 18.

The door jamb reinforcing apparatus of the present invention comprises first and second elongate metal plates 40,50 respectively.

The first flat elongate metal plate 40 is adapted to be mounted flush with the inner bolt receiving face 20 of the door jamb. The first plate 40 is between about 24 and about 80 inches in length and is approximately 1.75 inches in width. Furthermore, the first plate 40 is fabricated from 18 gauge stainless steel and includes a hole defining a bolt receiving opening 46 located centrally along the length of the plate 40. In addition, a plurality of spaced apart openings 48 adapted to receive mounting screws are located approximately every nine inches along the length of the plate 40.

The second elongate metal plate 50 has an L-shaped cross-section and includes a first side 52 and a second side 54. The second metal plate is also fabricated from 18 gauge stainless steel and is between about 24 and about 80 inches in length. The first side 52 is approximately 1.75 inches in width and the second side is approximately 0.25 inches in width. The first side 52 of the second plate 50 includes a hole defining a bolt receiving opening 56 located centrally along the length of the plate 50 and a plurality of spaced apart, countersunk openings 58 adapted to receive mounting screws are located approximately every nine inches.

Figure 4:
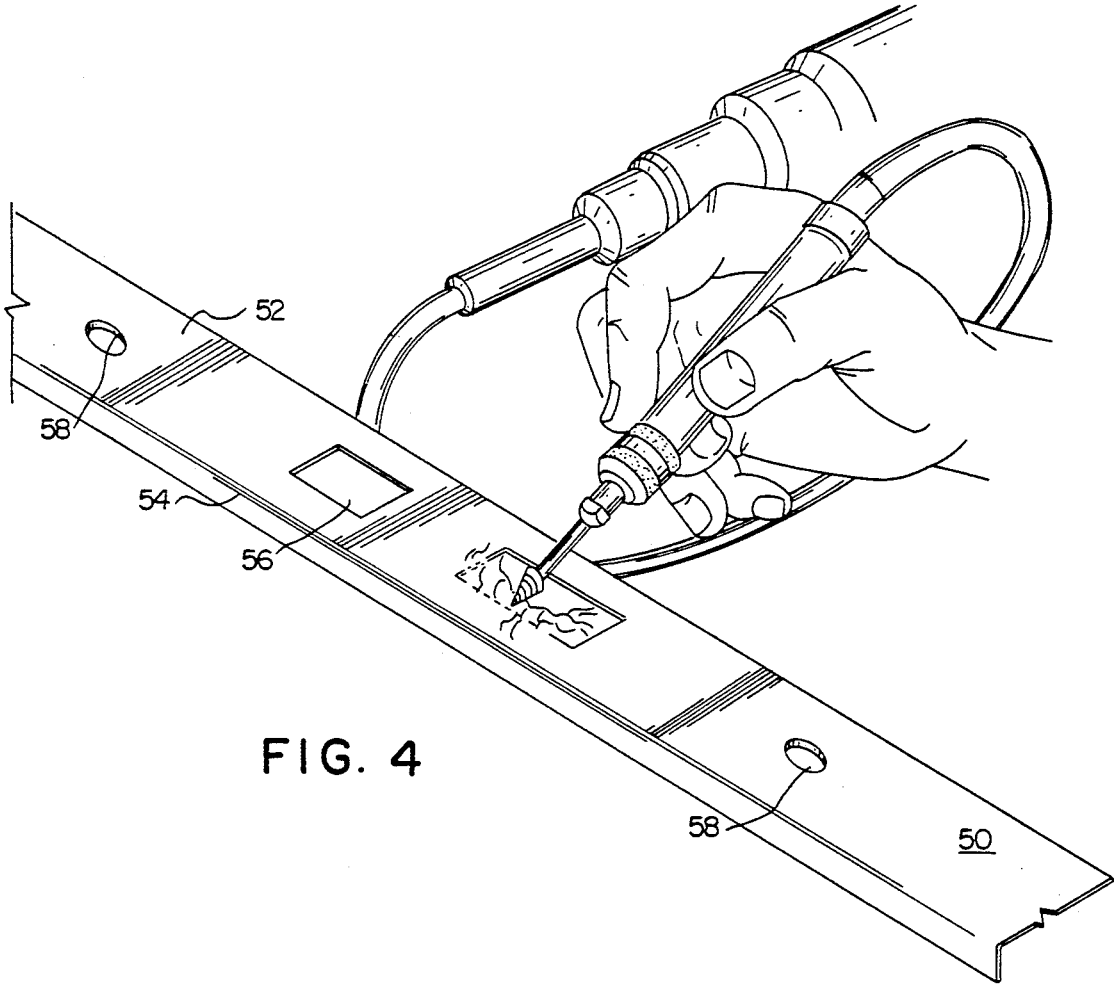
FIG. 4 is a perspective view of one of the door jamb reinforcement plates according to the present invention with cutouts for the dead bolt and door latch being fabricated with a cutting tool.

An additional feature of the present invention resides in the ability of the installer to cut openings in the plates 40,50 to accommodate additional dead bolts or latches by using common cutting tools such as tin snips or a Dremmel tool (see FIG. 4). In this manner, the door jamb reinforcing apparatus of the present invention is universally adaptable to virtually every door jamb. Furthermore, by employing two separate metal plates, each of which is relatively thin, the reinforcer may be easily installed beneath the door frame molding while still substantially maintaining the degree of reinforcement provided by prior systems.

Installation of the door jamb reinforcing apparatus is also simple and fast. First, the striker plate is removed from the door frame. Then the inner face of the door jamb is planed or cut, if necessary, in order to provide enough clearance for the door to freely open and close. Next, the first plate is fitted to the door jamb and additional openings for dead bolts and latches maybe cut, if required. Thereafter, the first plate is tacked in position using a nail inserted in one of the holes. Similar openings are then cut in the second plate which is then similarly positioned over the nail and is carefully wedged between the wall on the underside of the molding. The metal plates 40,50 are then secured to the door jamb by inserting mounting screws (preferably 3–4 inches in length) 60 into each of the screw openings 44,58 and screwing them into the adjacent framing studs. In this manner, the door jamb is strengthened as the door jamb reinforcing apparatus is structurally interconnected with the wall and as a result, the amount of force required to obtain forced entry through the door is substantially increased and forced entry is, therefore, more difficult.

It will be understood that the dimensions given in the example are merely illustrative of the invention and that given the wide variety in door dimensions, that modifications may be made in order to adapt the invention to a particular door frame without departing from the scope of the invention. Furthermore, in the drawings and specifications there has been disclosed a preferred embodiment of the invention, and although specific terms are employed, they are used in a generic and descriptive sense only, and not for the purpose of limitation.

That which is claimed is:

1. An apparatus for reinforcing a door jamb of the type having an inner bolt receiving face and a perpendicular outer face normally covered by a decorative molding and comprising:

a first flat elongate metal plate adapted to overlie a portion of the inner bolt receiving face of a door jamb and including a hole defining a bolt receiving opening and a plurality of spaced apart openings adapted to receive mounting screws;

a second thin elongate metal plate having an L-shaped cross-section and including a first side adapted to overlie the first metal plate and a second side, said first side including a second bolt receiving opening and a second plurality of spaced apart holes defining second mounting screw openings adapted to receive mounting screws, said second side of the second elongate metal plate being adapted to be slidably inserted beneath a portion of the decorative molding and adapted to lie in contacting abutting relation with a portion of the outer face of the door jamb, and wherein said second bolt receiving opening and said second mounting screw openings corresponding to the respective openings in said first plate;

whereby said first plate and said second plate can be connected to a door jamb in overlying contacting abutting relation with each other and with the door jamb to strengthen the door jamb.

2. An apparatus for reinforcing a door jamb according to claim 1 wherein said first and second metal plates are between about 24 and about 80 inches in length.

3. An apparatus according to claim 2 wherein openings in the second plate that are adapted to receive mounting screws are countersunk to increase the structural interconnection between the first and second plates when they are screwed to the door jamb.

4. An apparatus according to claim 1 wherein said first and second mounting plates are fabricated from 18 gauge metal.

5. An apparatus according to claim 1 wherein said second side of said second metal plate is less than one-half inch in length.

6. The apparatus according to claim 1 wherein said second side of said second metal plate has a thickness that enables it to be mounted beneath the door frame molding without requiring the removal thereof.

* * * * *